United States Patent [19]

Alvarez et al.

[11] 4,151,104

[45] Apr. 24, 1979

[54] BUILT LIQUID BLEACHING COMPOSITIONS

[75] Inventors: Vincent E. Alvarez, Livermore; Lodric L. Maddox, Oakland, both of Calif.

[73] Assignee: The Clorox Company, Oakland, Calif.

[21] Appl. No.: 875,404

[22] Filed: Feb. 6, 1978

[51] Int. Cl.[2] ..... C11D 7/56

[52] U.S. Cl. ..... 252/99; 252/187 H

[58] Field of Search ..... 252/99, 187 H

[56] References Cited

U.S. PATENT DOCUMENTS 4,005,027 1/1978 Hartmann ..... 252/99

OTHER PUBLICATIONS

Sodium Phosphates for Industry, Monsanto Chem. Co., Sep. 1, 1961, p. 15.

*Primary Examiner*—Mayer Weinblatt

*Attorney, Agent, or Firm*—Phillips, Moore, Weissenberger, Lempio & Majestic

[57] ABSTRACT

An aqueous bleaching composition having a pH from about 11 to 14, comprising an alkali metal hypochlorite, an alkali metal orthophosphate buffer, and an alkali metal pyrophosphate builder. The buffer increases the stability of the hypochlorite formulation to be comparable to a non-built composition of equal hypochlorite content despite the solution's increased ionic strength. The builder significantly aids in soil removal during laundering operations.

3 Claims, No Drawings

BUILT LIQUID BLEACHING COMPOSITIONS

BACKGROUND OF THE INVENTION

1. Field of the Invention

This invention relates to a new composition of matter useful in laundry operations. More specifically, an aqueous composition comprising hypochlorite bleach, a buffer, and a builder has been discovered.

The compositions of the invention are unexpectedly stable so as to provide comparable shelf life and aging performance to conventional liquid bleaches. Further, the compositions of the invention contain a builder which substantially improves soil removal during laundry operations. These desirable results have not heretofore been obtainable from a single liquid hypochlorite bleaching composition.

2. Prior Art

Conventional liquid hypochlorite bleaches used for laundry operations contain sodium hypochlorite which aids in removing stains and soils from textiles by virtue of the strong oxidizing power of the hypochlorite ion released in aqueous solution. The bleaching strength of an aqueous solution containing hypochlorite ion is measured as available chlorine. Hypochlorite ion is unstable over a period of time and changes ultimately to chloride ion and chlorate in aqueous solution with a corresponding loss of available chlorine. Overall, the decomposition of hypochlorite ion to chloride represents an undesirable loss of oxidizing power of the solution during shelf life. A conventional aqueous hypochlorite bleach with 5.25 nominal weight percent sodium hypochlorite should have a calculated amount of 5.0 percent available chlorine. Several months shelf life with at least this nominal amount of hypochlorite is assured by initially preparing a formulation with 5.7 to 5.8 weight percent sodium hypochlorite.

An aqueous solution of sodium hypochlorite is inherently basic as it is the salt of a weak acid (hypochlorous acid) and a strong base (sodium hydroxide). Since it is well known that hypochlorite ion is stabilized by basic solutions, conventional aqueous hypochlorite bleaches usually incorporate small amounts of sodium hydroxide or sodium carbonate, which adjust the solution to a pH of about 10.5 to 12.0. Nevertheless, the decomposition of the hypochlorite proceeds (although at an acceptable rate to provide adequate storage stability).

Another factor which is known concerning aqueous hypochlorite bleaching systems is that generally increasing the ionic strength of these conventional hypochlorite solutions further decreases the stability of the hypochlorite. As a consequence, although sodium carbonate buffering systems do somewhat retard the instability of the hypochlorite species by raising the pH, the use of additional soluble components (which would increase the solution's ionic strength) has appeared to be foreclosed. Thus, although bleaching systems which incorporate desirable builder components are known in the dry (non-aqueous) state, aqueous solutions of these dry bleaching systems would not have an acceptable shelf life.

SUMMARY OF THE INVENTION

In general, the compositions of this invention comprise three essential components: an aqueous hypochlorite bleaching agent, an inorganic buffering substance which maintains the composition pH within the range from about 11 to about 14, and an alkaline stable builder.

The hypochlorite agent is in an amount from about 1.5 to about 7 weight percent of sodium hypochlorite; the inorganic buffer is in an amount from about 0.5 to about 5.5 weight percent of a tri-sodium or tri-potassium orthophosphate; the builder is in an amount from about 4.0 to about 20 weight percent of a tetra-sodium or tetra-potassium pyrophosphate; and, the balance of the composition is water.

It is an object of this invention that the aqueous hypochlorite bleaching agent provides comparable bleaching action to conventional aqueous hypochlorite bleaches over the period of expected shelf life.

It is another object of this invention that the compositions contain a builder to assist in removal of soils and stains during laundering operations.

It is a further object of this invention that both the bleaching and the builder action of the compositions be obtainable in a single hypochlorite bleaching solution.

DETAILED DESCRIPTION OF THE PREFERRED EMBODIMENTS

The compositions of this invention are capable of providing both chemical bleaching and detergent building during laundering. The inventive compositions, although having relatively high ionic strengths, are remarkably stable over an extended period of time so that they can be packaged, shipped and stored, yet provide bleaching action at the time of use comparable to conventional (not-built) aqueous hypochlorite bleaches.

Conventional aqueous hypochlorite bleaches incorporate a small amount of sodium hydroxide or sodium carbonate to buffer the pH thereof to be about 10.5 to 12.0. These bleaches, however, exhibit significant hypochlorite decomposition. This decomposition is illustrated in Table 1, wherein a conventional aqueous hypochlorite bleach was subjected to accelerated decomposition conditions. The available chlorine illustrated in Table 1 is that fraction obtained by dividing the weight percent of active hypochlorite after a lapse of time in weeks by the weight percent of hypochlorite ion at formulation period, and converting to a percentage. It should be noted that all percent figures appearing in this specification are by weight unless otherwise specified.

TABLE 1

Solution: 5.14% NaOCl; 0.5% $Na_2CO_3$; pH: 10.5
Conditions: 120° F.

| Time (Weeks) | % Available Chlorine Remaining |
|---|---|
| 0 | 100 |
| 1 | 81 |
| 2 | 68 |
| 3 | 54 |
| 4 | 37 |
| 5 | 24 |
| 6 | 14 |
| 7 | 9 |
| 8 | 6 |

It has been recently surprisingly discovered that sufficient amounts of a specific buffering component which maintain the aqueous hypochlorite bleaching solution at pH 11.5 to 14 can stabilize the hypochlorite bleaching agent in the presence of sufficient alkaline stable builder component to aid in detergent action, despite the increased ionic strength of the aqueous hypochlorite solution.

This increased stability of the hypochlorite species is unexpectedly greater than obtained by merely raising the pH of solutions with comparably increased ionic strengths. This surprising increase in hypochlorite stability is illustrated in Table II which compares solutions incorporating sodium chloride, sodium chloride plus sodium hydroxide, and sodium chloride plus sodium perchlorate. Sodium chloride was utilized to increase the ionic strengths of hypochlorite solutions. This increase in ionic strength would be expected to greatly decrease the hypochlorite stability. Since chloride ion is reported to have an especially deleterious effect on the irreversible decomposition of hypochlorite, sodium perchlorate was also used to increase ionic strength of a comparison solution. Table II illustrates that the hypochlorite stability in a composition of the invention is considerably greater than can be attributed to merely increasing the pH (as illustrated by the addition of sodium hydroxide).

TABLE II

Comparison Formulations

Five sodium hypochlorite solution formulations were prepared and subjected to rapid aging conditions (120° F. over a period of 8 weeks. Comparisons between these five solutions illustrate the surprising hypochlorite stability for a composition of the invention despite the presence of the builder component.

The first sodium hypochlorite solution is a composition of the invention (Solution A). The second sodium hypochlorite solution is a formulation containing a large amount of sodium chloride (Solution B). The third solution is a formulation with a large amount of sodium perchlorate (Solution C). The fourth solution is a formulation similar to solution B, but with raised pH due to sodium hydroxide (Solution D). The fifth solution is a formulation of sodium hypochlorite and sodium carbonate (Solution E). All five solutions were formulated with the identical weight percentage of sodium hypochlorite, the value of which was chosen for effectiveness and convenience. Solutions A-D had a calculated ionic strength of 3.5 (ionic strengths calculated by taking one-half of the sum obtained from adding the products of the respective species molarities times the square of the respective species ionic charge).

| Solution A | Solution B |
|---|---|
| 3.16% NaOCl | 3.16% NaOCl |
| 2.48% NaCl | |
| 2.12% $K_3PO_4$ | 15.35% NaCl |
| 5.60% $K_4P_2O_7$ | rest $H_2O$ |
| rest $H_2O$ | |
| pH 12.1 | pH 11.3 |
| **Solution C** | **Solution D** |
| 3.16% NaOCl | 3.16% NaOCl |
| 24.49% $NaClO_4$ | 15.35% NaCl |
| 2.48% NaCl | 0.05% NaOH |
| rest $H_2O$ | rest $H_2O$ |
| pH 10.3 | pH 12.1 |
| **Solution E** | |
| 3.16% NaOCl | |
| 0.3% $Na_2CO_3$ | |
| rest $H_2O$ | |
| pH 11.2 | |

Stability Data:

| | % Available Chlorine Remaining After 0 to 8 Weeks | | | | |
|---|---|---|---|---|---|
| Solutions: | A | B | C | D | E |
| Weeks 0 | 100 | 100 | 100 | 100 | 100 |
| 1 | 88 | 84 | 83 | 86 | 95 |
| 2 | 83 | 72 | 69 | 74 | 89 |
| 3 | 77 | 62 | 60 | 65 | 82 |
| 4 | 71 | 53 | 51 | 57 | 77 |
| 5 | 65 | 36 | 31 | 51 | 72 |
| 6 | 61 | 21 | 28 | 46 | 68 |
| 7 | 57 | 12 | 17 | 41 | 64 |
| 8 | 54 | 8 | 11 | 37 | 61 |

Stability data for these five solutions illustrates the unexpected increase in hypochlorite stability of Solution A, a composition of the invention, over solutions B, C and D. Solutions A, B and C would be expected to demonstrate a greatly decreased hypochlorite stability effect due to the increase in ionic strength. Such effect is indeed found in solutions B and C. By contrast, Solution A represents a hypochlorite bleaching system with excellent stability.

Raising the pH of Solution B, as illustrated by Solution D, provides an increase in hypochlorite stability, but not the unexpectedly greater increase displayed by a composition of the invention. Further, comparing Solution B to C illustrates that the effect of chloride and perchlorate is almost equivalent for solutions at equal ionic strength. Solution E illustrates that a formulation solely comprised of sodium hypochlorite at 3.16 weight percent provides slightly more available chlorine than Solution A.

Bleaching Agent

The bleaching agent component is nominally present from about 0.5% to about 7.0%, preferably above about 1.5%. The bleaching component can be any of the hypochlorite bleaching agents, although the alkali metal hypochlorites are preferred, and sodium hypochlorite is especially desirable due to its ready availability and low cost.

Buffering Agent:

The buffering substance is present in the compositions in an amount which falls within the range from about 0.1% to about 10%, preferably from about 0.5% to about 5.5%, and should be selected to be in an amount adequate for maintaining the composition pH from about 11 to about 14, preferably from about 11.5 to 14, more preferably from about 11.5 to about 13. It is especially preferred that the pH be maintained at about 12.5.

The unexpected hypochlorite stability in the presence of sufficient amounts of builder for detergent assistance was surprisingly discovered to depend on the choice of sodium or potassium orthophosphate as the buffer. The tri-potassium orthophosphate is especially preferred when the bleach is high in sodium ion contact as in such instances the tri-sodium orthophosphate would have limited solubility. To maintain the desired pH range the orthophosphate will be in the tribasic form.

Builder

The builder must be stable in alkaline solutions of pH between about 11 and 14, and must be present in a sufficient amount to significantly aid detergent action during laundering operations. Detergent action assistance by the builder is partially due to its sequestration of alkaline earth metal ions such as calcium or magnesium present in hard water.

The builder is desirably present in compositions of the invention in an amount from about 4% to about 20%. A builder to buffer weight ratio of not less than about 1.5 to 1 is preferred for efficient soil and stain removal. Increased amounts of builder can be utilized, depending upon the expected variations of detergent and water hardness encountered in laundering operations. The alkaline builder substance must be sodium or potassium pyrophosphate. Tetrapotassium pyrophosphate is especially preferred when the bleach is high in sodium ion content as in such instances the tetra-sodium pyrophosphate would have limited solubility.

CLEANING PERFORMANCE

Various compositions of the invention were prepared. These compositions displayed hypochlorite stability equal to or better than that of conventional aqueous hypochlorite bleach of comparable ionic strength.

Cleaning experiments as described in the following examples illustrate that the compositions of the invention can provide comparable bleaching action and superior removal of soil during laundering operations. Each example was performed under the following conditions:

The detergent was Tide (a trademark of Procter & Gamble Company at 6.1% phosphate) and 75% of the manufacturer's recommended quantity was utilized. Fabrics were washed at 105° F. for 10 minutes, rinsed at 95° F. for 5 minutes and then dried in a tumble drier at about 145° F. for 15 minutes. The water hardness was calculated as 120 parts per million calcium carbonate equivalent.

Identical procedures were followed in applying ink stains. All ink swatches were aged for an identical time period. Each group (Groups A and B) of sebum soil swatches was prepared and treated in an identical manner. Percentage stain removal for the ink-stained swatches was determined according to the Association of American Textile Chemists and Colorists, test method 130. Percentage stain removal for the sebum-soiled swatches was calculated according to the Kubelka-Munk equation, and triplicate swatches were run in each experiment for precision. Sebum soil removal No. 1 (Group A) was performed on cotton; sebum soil removal No. 2 (Group A) was performed on polyester-cotton (65% polyester, 35% cotton); sebum soil removal No. 3 (Group B) was performed on cotton; sebum soil removal No. 4 (Group B) was performed on polyester-cotton (65% polyester, 35% cotton); ink stain removal was performed on cotton. Compositions of the invention was all rapidly aged at 120° F. for one week to simulate shelf life, and then tested for available chlorine according to standard chemical procedures. The composition of each inventive built bleach is listed in the examples.

Six formulations (I-VI) for compositions of the invention were prepared, detergent added to each, and compared to cleaning performance of a conventional aqueous hypochlorite bleach solution including detergent. These six formulations demonstrate: (I) improved soil removal but inferior bleaching at very low hypochlorite concentration; (II) improved soil removal and comparable stain removal of an optimal formulation; (III) improved soil removal and comparable bleaching of a relatively low amount of buffer in co-operation with a relatively low concentration of sodium hypochlorite; (IV) improved soil removal and comparable bleaching with a very high amount of builder; (V) improved soil removal and comparable bleaching where the builder to buffer weight ratio is about 1.5:1; and (VI) marginally improved soil removal and comparable bleaching where the builder to buffer weight ratio is 0.5:1.

FORMULATIONS OF THE INVENTION

| I | II |
|---|---|
| 0.66% NaOCl | 3.32% NaOCl |
| 4.48% $K_3PO_4$ | 3.01% $K_3PO_4$ |
| 13.45% $K_4P_2O_7$ | 9.03% $K_4P_2O_7$ |
| 0.52% NaCl | 2.61% NaCl |
| rest $H_2O$ | rest $H_2O$ |
| % Available chlorine remaining, 95 (after 1 week) | % Available chlorine remaining, 85 (after 1 week) |
| Ionic strength, 7.09 | Ionic strength, 5.48 |
| pH initial, 12.96 | pH initial, 12.53 |
| pH after 1 week, 12.79 | pH after 1 week, 12.49 |
| **III** | **IV** |
| 1.66% NaOCl | 1.66% NaOCl |
| 0.50% $K_3PO_4$ | 3.01% $K_3PO_4$ |
| 9.03% $K_4P_2O_7$ | 16.55% $K_4P_2O_7$ |
| 1.30% NaCl | 1.30% NaCl |
| rest $H_2O$ | rest $H_2O$ |
| % Available chlorine remaining, 95 (after 1 week) | % Available chlorine remaining, 85 (after 1 week) |
| Ionic strength, 3.75 | Ionic strength, 8.06 |
| pH initial, 11.97 | pH initial, 12.88 |
| pH after 1 week, 11.94 | pH after 1 week, 12.79 |
| **V** | **VI** |
| 1.66% NaOCl | 1.66 NaOCl |
| 5.51% $K_3PO_4$ | 3.01% $K_3PO_4$ |
| 9.03% $K_4P_2O_7$ | 1.50% $K_4P_2O_7$ |
| 1.30% NaCl | 1.30% NaCl |
| rest $H_2O$ | rest $H_2O$ |
| % Available chlorine remaining, 92 (after 1 week) | % Available chlorine remaining, 100 (after 1 week) |
| Ionic strength, 6.17 | Ionic strength, 2.16 |
| pH initial, 13.18 | pH initial, 12.66 |
| pH after 1 week, 12.83 | pH after 1 week, 12.37 |

CONVENTIONAL COMPARISON FORMULATION:

5.4% NaOCl
0.5% $Na_2CO_3$
4.24% NaCl
rest $H_2O$
% Available chlorine remaining, 81 (after 1 week)
Ionic strength, 1.57
pH initial, 10.95
pH after 1 week, 10.45

SOIL AND STAIN REMOVAL DATA:

| | % Sebum Removal: | | | |
|---|---|---|---|---|
| | Group A Sebum Soil Removal | | Group B Sebum Soil Removal | |
| | 1 | 2 | 3 | 4 |
| Composition: | | | | |
| I | 87.9 | 86.3 | 77.1 | 97.8 |
| II | 89.7 | 86.2 | 76.7 | 98.0 |
| III | 87.2 | 86.0 | 76.0 | 99.0 |
| IV | 87.4 | 86.3 | 77.1 | 98.5 |
| V | 88.3 | 86.0 | 75.7 | 97.7 |
| VI | 86.2 | 83.7 | 74.9 | 96.1 |
| Comparison Formulation | 86.0 | 82.6 | 68.8 | 97.6 |

By comparative examination of the above data for composition I it will be apparent that a formulation with very low concentrations of sodium hypochlorite provides increased soil removal over conventional aqueous hypochlorite bleach and an increased stability of the hypochlorite; such extremely low NaOCl concentrations do not provide comparable ink stain removal.

By comparative examination of the above data for composition II, it will be apparent that this optimal formulation of the present invention provides significantly improved sebum soil removal performance and comparable bleaching action illustrated by ink stain removal to conventional aqueous hypochlorite bleach, yet the hypochlorite concentration is considerably less than the conventional aqueous bleach solution.

By comparative examination of the above data for composition III it will be apparent that even formulations incorporating relatively low weight percentages of the critical buffering component provide superior soil removal properties.

By comparative examination of the above data for composition IV it will be apparent that improved soil removal and comparable bleaching action (% ink stain removal) to conventional aqueous bleach is provided despite the greatly increased ionic strength due to the presence of relatively large amounts of the builder component. This comparable bleaching action may be at least partially due to the increased stability accorded to the present invention by the unique buffering component.

By comparative examination of the above data for composition V it will be apparent that a relatively large amount of the buffering component present in a composition of the invention wherein the builder to buffer ratio is not less than 1.5 to 1 provides generally improved soil removal and comparable bleaching action over a conventional aqueous hypochlorite bleach.

From the comparative data for composition VI, the builder component concentration is quite low, and the builder to buffer ratio is considerably less than 1.5 to 1. Soil removal is nonetheless improved, and bleaching action is comparable to a conventional aqueous hypochlorite bleach combined with detergent. This formulation appears to provide an extremely well stabilized hypochlorite bleaching system.

In summary, the compositions of the invention provide for built aqueous bleaching solutions in a single product. Such inventive compositions contain a specific buffering component which co-operates to provide surprising stability for the hypochlorite bleaching agent, despite the increased ionic strength due to the builder and buffering components. Further, the inventive compositions provide generally comparable bleaching action to conventional hypochlorite aqueous bleaches. Finally, the builder component of these compositions assists in removal of soils and strains during laundering operations. The three essential components must be present in the formulation ranges, and the minimum builder to buffer ratio must be such so as to cooperate for a balance between increased hypochlorite stability, bleaching action, and soil and stain removal.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A built aqueous bleaching composition for addition to fabric laundering solutions containing detergents consisting essentially of:

(a) from about 1.5% to about 7% weight of sodium hypochlorite;

(b) from about 0.5% to about 5.5% by weight of an alkali metal orthophosphate buffer where the alkali metal is selected from the group consisting of sodium and potassium and is a tri-alkali metal orthophosphate, wherein the buffer maintains the pH of the composition to fall within the range from about 11.5 to about 13, and stabilizes the hypochlorite during shelf life;

(c) from about 4.0% to about 20% by weight of an alkali metal pyrophosphate builder where the alkali metal of the pyrophosphate builder is selected from the group consisting of sodium and potassium and is a tetra-alkali metal pyrophosphate, and the builder to buffer weight ratio is not less than 1.5 to 1, and the builder assists the detergent soil removal action of said laundering solution during fabric laundering; and (d) the balance water.

2. A composition as in claim 1, wherein:

(a) the buffer is tri-potassium orthophosphate;

(b) the builder is tetra-potassium pyrophosphate.

3. A composition as in claim 2 wherein:

The sodium hypochlorite is in an amount of at least 3% by weight; and

The tetra-potassium pyrophosphate is in an amount of at least 9% by weight.

* * * * *

UNITED STATES PATENT AND TRADEMARK OFFICE

CERTIFICATE OF CORRECTION

PATENT NO. : 4,151,104

DATED : April 24, 1979

INVENTOR(S) : VINCENT E. ALVAREZ ET AL

It is certified that error appears in the above-identified patent and that said Letters Patent are hereby corrected as shown below:

Column 4, line 54, "contact" should read --content--.

Column 6, line 60, remainder of table below was omitted:

-- % Ink Removal

| Composition: | |
|---|---|
| I | 40 |
| II | 90 |
| III | 90 |
| IV | 90 |
| V | 90 |
| VI | 90 |
| Comparison Solution | 90 --. |

Column 8, line 2, "strains" should read --stains--.

Signed and Sealed this

Twelfth Day of February 1980

[SEAL]

Attest:

SIDNEY A. DIAMOND

Attesting Officer

Commissioner of Patents and Trademarks